US005772401A

United States Patent [19]

Canova

[11] Patent Number: 5,772,401

[45] Date of Patent: Jun. 30, 1998

[54] DIAPHRAGM CONSTRUCTION FOR TURBOMACHINERY

[75] Inventor: Fred Canova, Moneta, Va.

[73] Assignee: Dresser-Rand Company, Corning, N.Y.

[21] Appl. No.: 543,066

[22] Filed: Oct. 13, 1995

[51] Int. Cl.[6] ..... F01D 9/04

[52] U.S. Cl. ..... 415/189; 415/208.2; 415/209.3; 415/209.4; 29/417; 29/889.22

[58] Field of Search ..... 415/189, 190, 415/191, 193, 208.2, 209.1, 209.2, 209.3, 209.4, 210.1, 211.2, 214.1, 230; 29/415, 417, 889.22; 219/121.72, 121.85; 277/167.5, 236

[56] References Cited

U.S. PATENT DOCUMENTS

| | | | |
|---|---|---|---|
| 1,326,870 | 12/1919 | Junggren . | |
| 2,013,512 | 9/1935 | Birmann . | |
| 2,217,500 | 10/1940 | Spencer . | |
| 2,247,387 | 7/1941 | Johnson et al. . | |
| 2,247,423 | 7/1941 | Webster, Jr. . | |
| 2,530,908 | 11/1950 | Ray . | |
| 2,556,890 | 6/1951 | Thorn . | |
| 2,919,891 | 1/1960 | Oliver . | |
| 3,300,180 | 1/1967 | Tuttle et al. | 415/210.1 |
| 3,313,520 | 4/1967 | Ortolano et al. . | |
| 3,408,048 | 10/1968 | Scalzo . | |
| 3,788,767 | 1/1974 | Bednarczyk et al. . | |
| 3,861,827 | 1/1975 | Peabody . | |
| 3,947,150 | 3/1976 | Lohonen . | |
| 4,204,803 | 5/1980 | Leger et al. . | |
| 4,332,999 | 6/1982 | Wittke | 219/121.72 |

FOREIGN PATENT DOCUMENTS

| | | | |
|---|---|---|---|
| 57-0212305 | 12/1982 | Japan | 415/214.1 |

*Primary Examiner*—Christopher Verdier
*Attorney, Agent, or Firm*—Nixon, Hargrave, Devans & Doyle

[57] ABSTRACT

A highly accurate, reproducible and economnical method of manufacturing split diaphragms for use in turbomachinery wherein the diaphragm is first machined axially, and then split across the axial machining to for precision positioning channels into which a pin of matching dimensions is placed to preserve the circularity and stability of the diaphragm when the diaphragm pieces are replaced together about a turbine shaft. Alternatively, the diaphragm is split first and is then machined axially through the split to form precision positioning channels.

28 Claims, 7 Drawing Sheets

DIAPHRAGM CONSTRUCTION FOR TURBOMACHINERY

FIELD OF THE INVENTION

The present invention relates to the field of turbomachinery and especially to stabilizers used in the diaphragm assembly.

BACKGROUND OF THE INVENTION

Turbomachines including turbines and compressors of the axial flow type are provided with stationary blades or vanes supported in an annular row by a disk or inner ring member and an outer ring member, the entire structure being known and referred to as a diaphragm. The diaphragm structure is employed in conjunction with the rotating blades of the turbomachine to direct the fluid or gas flow to the rotating blades as it progresses through the successive stages of the turbomachine to impart a rotational torque to the turbine wheel and shaft.

Diaphragm structures are often initially formed or machined into a single piece to insure precise circularity. However, because the diaphragm must fit between disks of a rotor, the diaphragms are most often cut into halves to be placed into position about the turbine shaft. This facilitates maintenance and inspection of the turbines and obviates drastic disassembly of the turbomachinery.

Regardless of the precision with which the diaphragm is cut, some material must necessarily be removed from the diaphragm during the cutting process. The missing material cut from the diameter of the diaphragm results in loss of the circularity of the diaphragm when the halves are again juxtaposed. Circularity of the diaphragm can only be restored if the material lost during the cutting process is replaced at the cutting site. The cut site must also be sealed to prevent gas or fluid from leaking through it, thereby adversely affecting the efficiency of the turbomachine.

To restore diaphragm circularity lost by removal of metal, it has been the practice to "butter", or build up the two faces of the diaphragm at the site of cutting with material, such as weld material or other deposited metal. However, "buttering" up molten metal material at the diaphragm cutting site is not precise and does not satisfactorily reestablish circularity of the diaphragm. The material which is used to build up the diaphragm still has to be machined and smoothed down so that the two diaphragm halves will meet precisely to achieve a circular configuration. Such machining is necessarily done on an "as needed" basis with virtually no possible process standardization; i.e. the amount of machining being necessary varies with each diaphragm. This lack of standardization results in a lengthy step being added to the process, and requires additional measurement and rechecking to determine when the gap has been adequately replaced with machined weld material.

Inserts have been attempted in the place of the weld material. In U.S. Pat. No. 3,788,767 to Bednarczyk, et al., a keying member is inserted radially across the cut into a groove or gap. In U.S. Pat. No. 2,217,500 to Spencer, a key is positioned in a groove in a radial direction relative to the cut made in the diaphragm. The devices disclosed in these patents help to take up the space made by cutting the diaphragm. However, these devices do not adequately stabilize the diaphragm halves relative to each other so that some additional means are required to adequately stabilize the diaphragm halves.

SUMMARY OF THE INVENTION

According to the present invention, a highly accurate, reproducible and economical method of manufacturing a split diaphragm for use in a turbine assembly is disclosed wherein the diaphragm is first machined axially and then split across the axial machining. This combination of machining causes a precision recess or channel to be made, into which channel a pin may be placed. The pin has a shaft section and a head section at each end of the shaft. The head sections have a diameter larger than the shaft section.

According to the present invention, a method for machining a diaphragm for a turbomachine is disclosed. A one piece annular diaphragm having axially spaced first and second sides is provided. The diaphragm is drilled such that at least one hole of a first diameter is made from an entry point at the first side to an exit point at the second side of the diaphragm. The diaphragm is then cut into first and second pieces along a line intersecting the drilled holes to form matching axially extending positioning channels at the edges of the first and second pieces. A positioning pin is placed into each positioning channel of the first diaphragm piece. The pin is configured to conform to the dimensions of the positioning channel. The two diaphragm pieces are then joined by placing the second diaphragm piece together with the first diaphragm piece with each positioning channel of the second piece aligned with the positioning pin in the positioning channel of the first piece. The diaphragm pieces also have grooves cut into them, into which seals are placed. In an alternative method, the diaphragm is first cut into two pieces and then drilled to achieve the positioning channels.

According to a further feature of the present invention, a diaphragm for use in a turbomachine is disclosed. The diaphragm has an outer annular supporting structure, an inner annular supporting structure, and an annular blade row positioned therebetween. The inner annular supporting structure has an axial shaft opening with a diameter sufficient to receive a turbine shaft. The diaphragm is cut into two pieces having adjoining edges extending through the outer and inner annular supporting structures, the annular blade row and the opening. The diaphragm has axially extending positioning channels formed at the adjoining edges of the two diaphragm pieces. Positioning pins with dimensions matching that of the positioning channels are placed into the positioning channels between the two pieces.

According to a still further feature of the present invention, a turbine is disclosed comprising a diaphragm for use in a turbomachine. The diaphragm is as described above.

DETAILED DESCRIPTION OF THE INVENTION

Figure 1:
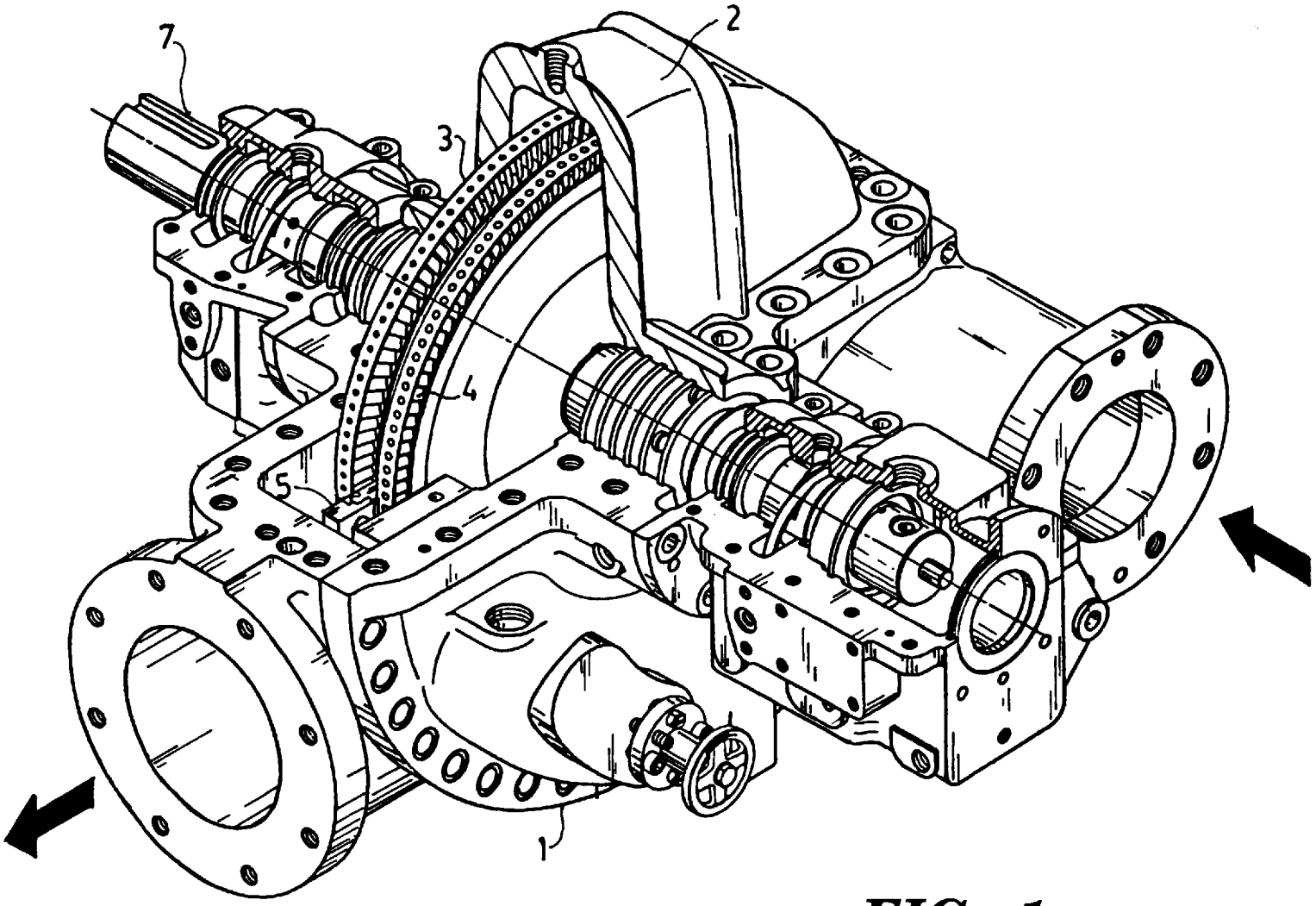
FIG. 1 is a perspective view of a partially exposed turbine.

Referring to the drawings in detail, FIG. 1 shows a partially exposed perspective view of a turbine assembly 1.

The outer casing 2 is drawn to give a partially exposed view of the rotating turbine blade rows 3, 4. Interposed between the two blade rows 3, 4 is a stationary diaphragm 5. The diaphragm 5 is installed as two pieces or halves about the turbine shaft 7. Therefore in FIG. 1, only the lower half of the diaphragm 5 is shown. In operation, the upper half of the diaphragm would be in place, disposed between the turbine blade rows 3, 4.

Figure 2:
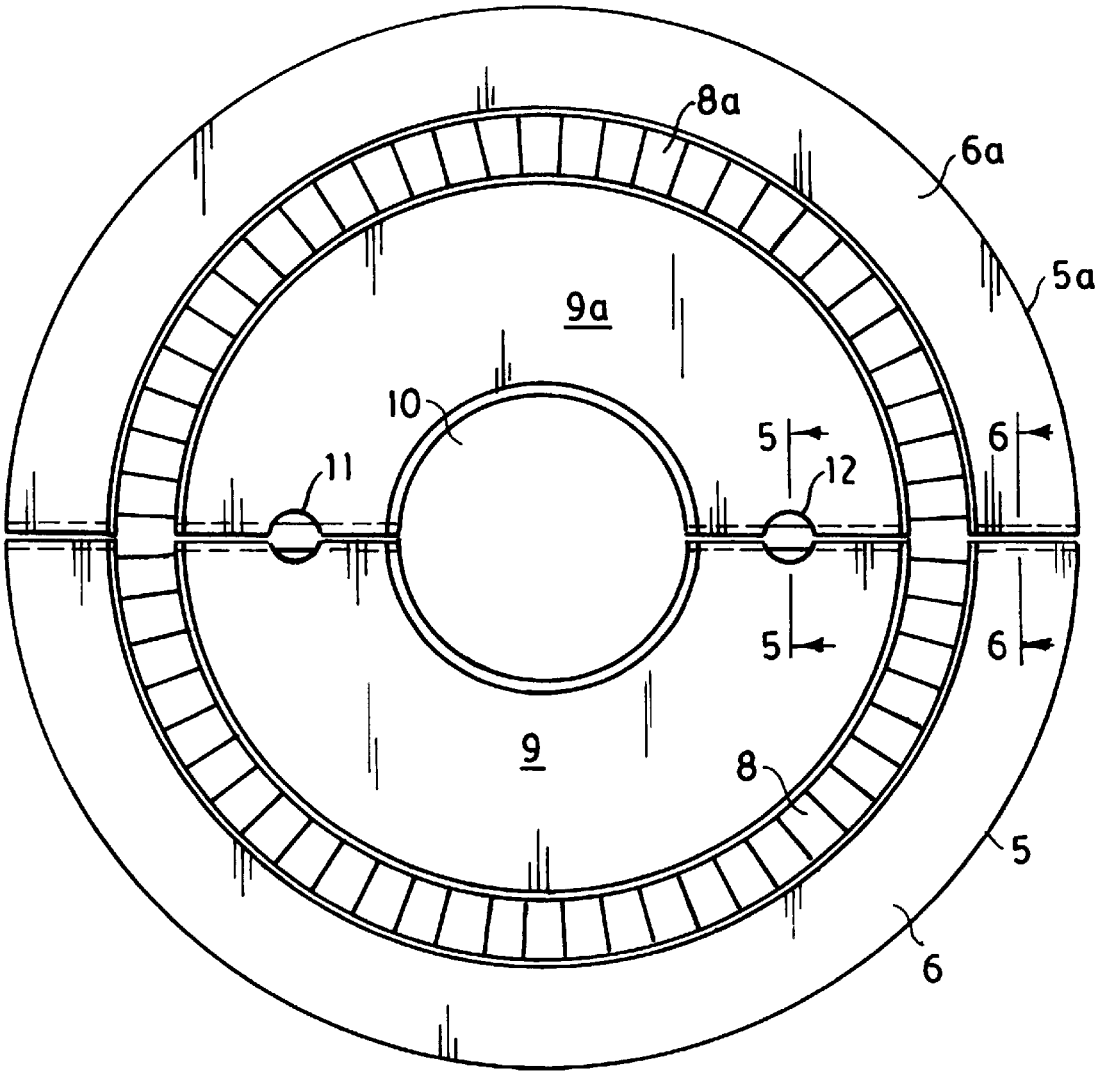
FIG. 2 is a front view of the turbine diaphragm.

FIG. 2 shows a front view of a diaphragm split into an upper half 5*a* and a lower half 5. The split diaphragm has a lower outer supporting structure 6 and an upper outer supporting structure 6*a*. A lower blade row 8 and upper blade row 8*a* is disposed between the outer lower and upper supporting structures 6, 6*a* and the inner lower and upper supporting structures 9, 9*a* respectively. The lower and upper inner supporting structures 9, 9*a'* join to form a shaft opening 10 through which a turbine shaft (not shown in FIG. 2) passes. Two axially drilled openings 11, 12 are drilled along the interface at which the lower diaphragm piece 5 and upper diaphragm piece 5*a* are juxtaposed.

Figure 3:
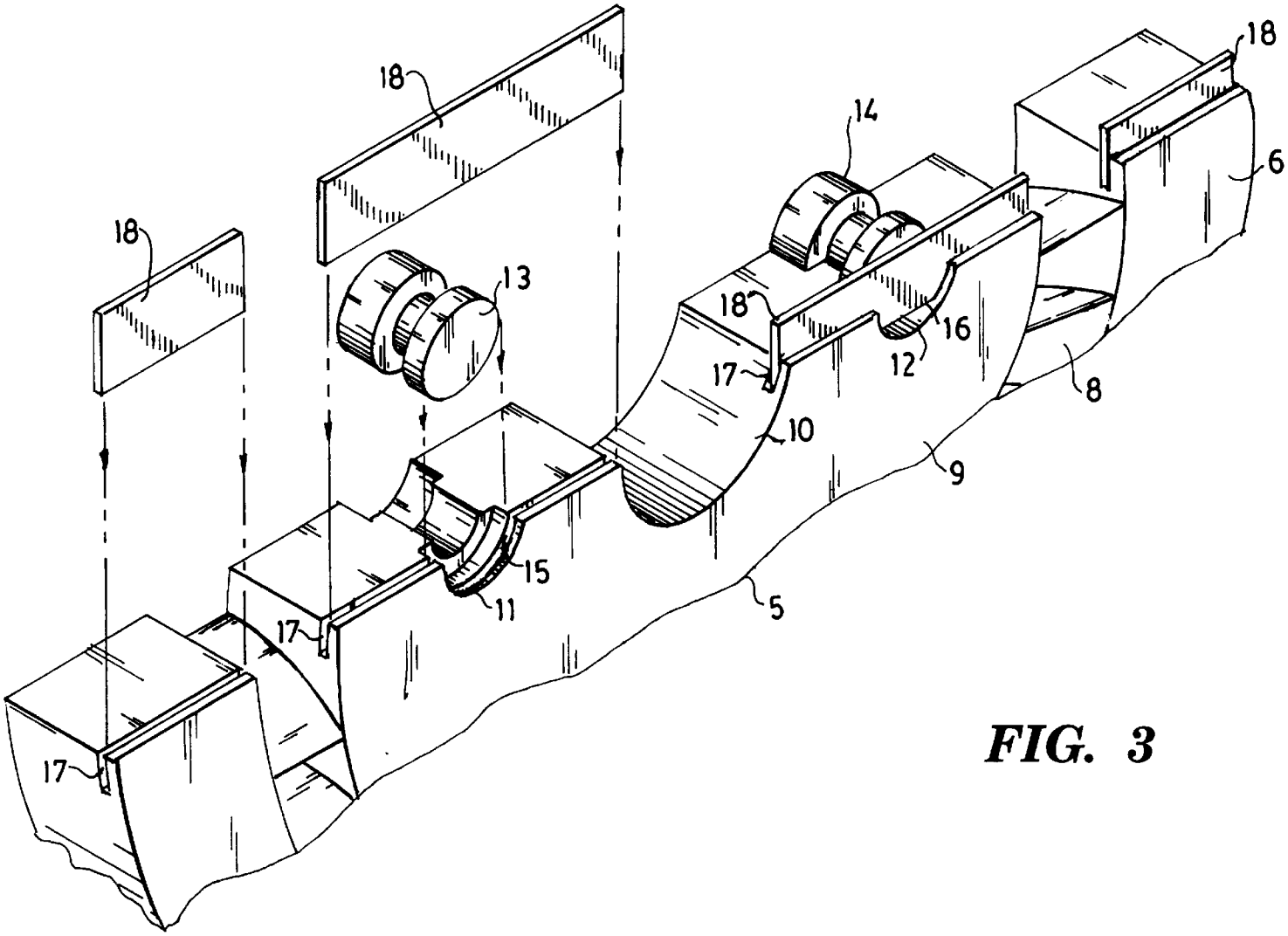
FIG. 3 is an exploded perspective view of the lower diaphragm piece of FIG. 2.

FIG. 3 shows a partially exploded perspective view of the lower diaphragm piece 5. Two positioning pins 13, 14 fit into two positioning channels 15, 16, respectively. A groove 17 is cut into the lower diaphragm piece 5, intersecting the two positioning channels 15, 16. Seals 18 fit into grooves 17.

Figure 4:
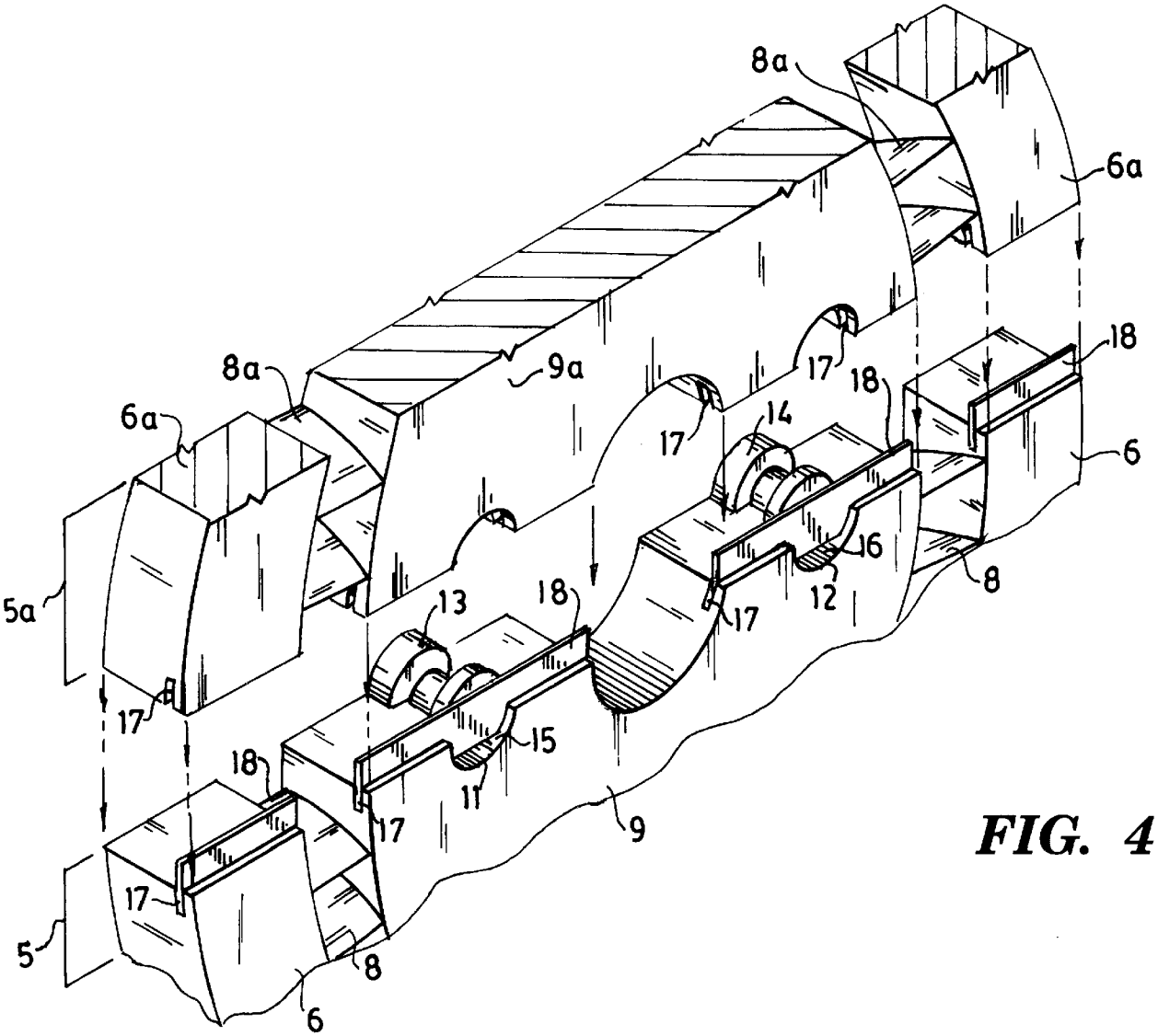
FIG. 4 is an exploded perspective view of the upper and lower diaphragm pieces of FIG. 2.

FIG. 4 shows the two positioning pins 13, 14 in position in the positioning channels 15, 16. The seals 18 are shown in position in the grooves 17. The upper diaphragm piece 5*a* is dimensioned to fit onto the lower diaphragm piece 5.

Figure 5:
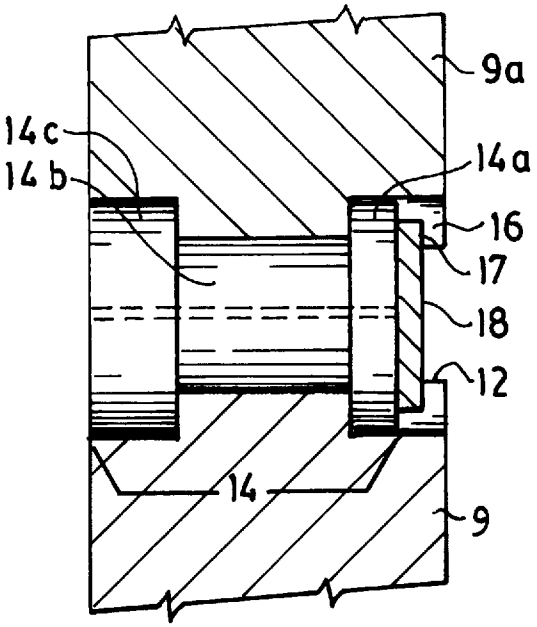
FIG. 5 is a side view of the exposed turbine diaphragm at line 5—5 of FIG. 2 showing the positioning pin in the positioning channel.

FIG. 5 is an exposed side view of a segment of the diaphragm at line 5—5 of FIG. 2. The inner supporting structure 9 is shown having an axially drilled opening 12 which has been intersected by a cut to make a positioning channel 16 (covered by the positioning pin 14). The positioning pin 14 is shown resting in the positioning channel 16. A seal 18 is placed over the front end portion 14*a* of the positioning pin 14. The pin 14 is comprised of a cylindrical shaft portion 14*b*, a front end portion 14*a*, and a back end portion 14*c*. The end portions have a diameter larger than the diameter of the shaft portion. As shown, the two end portions 14*a*, 14*c* have differing thicknesses and the same diameter. As shown in FIG. 5, the front end portion 14*a* is slightly thinner than the back end portion 14*c* to accommodate the seal 18 which fits into the groove 17, and covers the front end portion 14*a* of the pin 14.

Figure 6:
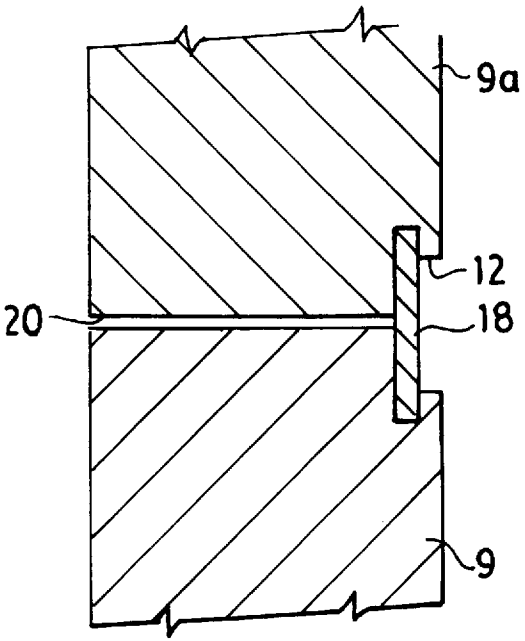
FIG. 6 is a side view of the diaphragm along line 6—6 of FIG. 2.

FIG. 6 is a side view of the split diaphragm along the line 6 of FIG. 2 in the outer supporting structure 9 of the turbine diaphragm, at the cut 20. For this view, it is understood that the outer diaphragm casing, ordinarily used in operation, is not in place. This view shows the function of the seal 18; to block gas or fluid flow from escaping through the gap left by the cut 20.

Figure 7:
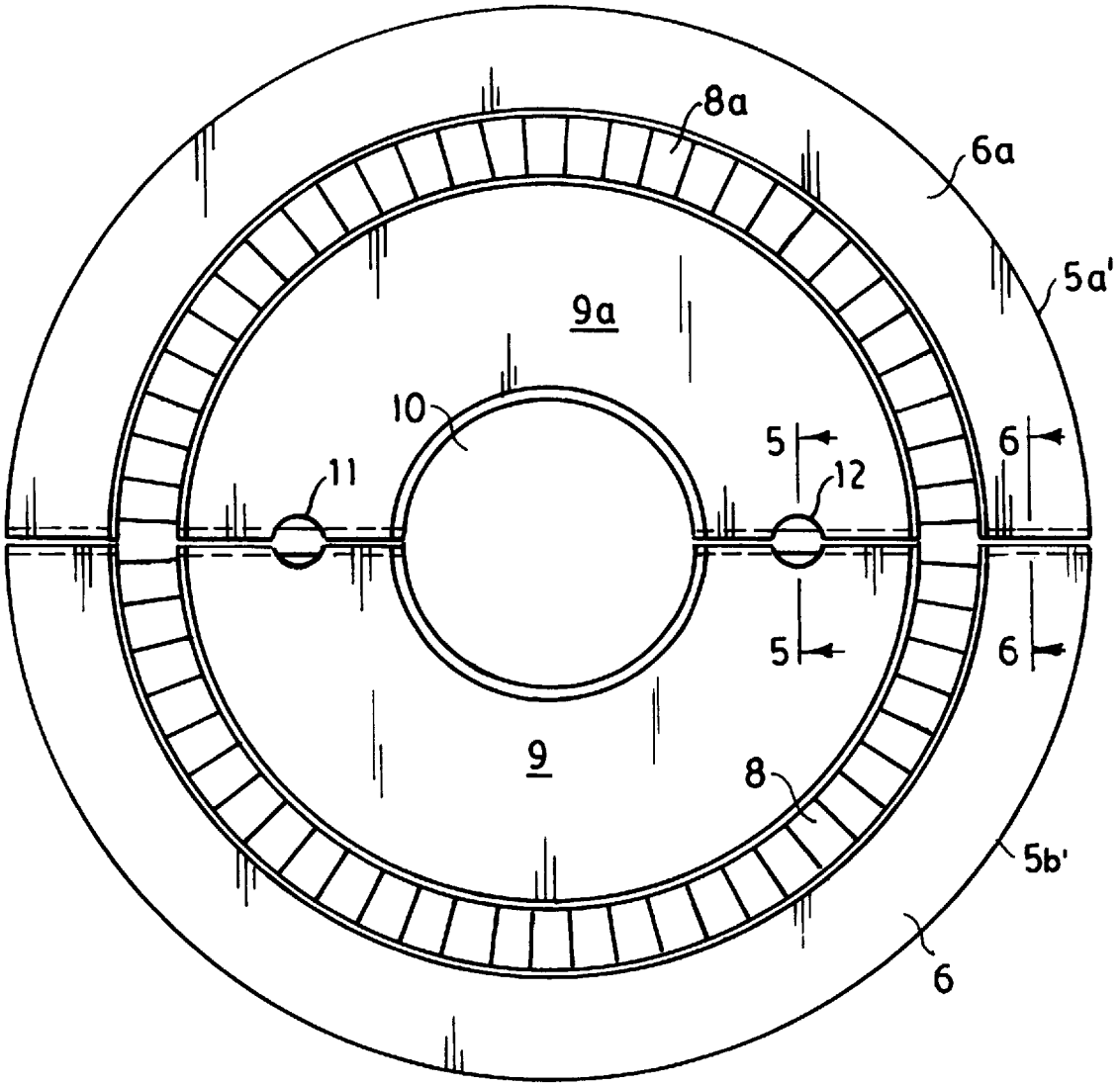
FIG. 7 is a front view of another embodiment of the turbine diaphragm.

FIG. 7 is a front view of another embodiment of the turbine diaphragm. As illustrated, the cutting is carried out non-diametrically across the diaphragm 5 and the diaphragm is split into an upper half 5*a'* and a lower half 5*b'* of differing dimensions.

Figure 8:
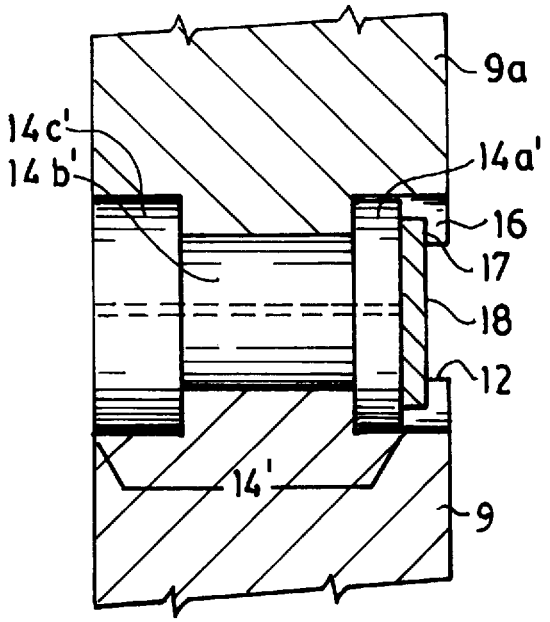
FIG. 8 is a cross-sectional view of another embodiment of the exposed turbine diaphragm showing the positioning pin in the positioning channel.

FIG. 8 is a cross-sectional view of another embodiment of the exposed turbine diaphragm showing the positioning pin in the positioning channel. As illustrated, the end portions 14*a'* and 14*c'*, between cylindrical shaft portion 146', of the positioning pin 14' have the same diameters and the same thicknesses or widths.

The diaphragm is initially machined into and provided as a single piece. According to one aspect of the invention, the diaphragm is first drilled axially, beginning at an entry point on the first side, and proceeding through to an exit point at the second side. As shown in FIG. 2, two holes 11, 12 are drilled axially through the diaphragm. In a preferred embodiment, the diameter of the entry and exit points are widened or increased as compared with the diameter of the drilled holes. This is accomplished by, for example, countersinking the holes. The diaphragm is then cut diametrically such that the drilled holes are intersected by the cut. The cut may be made by any tool capable of cutting through diaphragm materials, such as a blade or a laser beam. The cutting across the drilled holes creates positioning channels which are of a "dumbbell" configuration.

The "dumbbell" shaped positioning channels 15, 16 closely match the dimension and configuration of the positioning pins 13, 14. The pins 13, 14 accurately position the upper diaphragm piece 5*a* on the lower diaphragm piece 5 when the diaphragm is reassembled, for example, in a turbine engine about a turbine shaft. In addition, pins 13, 14 space diaphragm pieces 5*a* and 5 apart so the assembled diaphragm has the requisite circularity despite its having been previously cut in half. Since the pins 13, 14 preferably extend across the width of the diaphragm, greater stability is afforded the diaphragm pieces 5*a*, 5 relative to one another in the axial direction.

It is also the "dumbbell" configuration of the pins 13, 14 and the matching dimensions of the positioning channels 15, 16 into which the pins 13, 14 fit which renders this superior positioning stability in the z- and x-axes, as well as superior locating ability of the diaphragm piece 5*a*, 5 in the y-axis. The term "dumbbell" is meant to describe the shape of an object which has a shaft portion bounded by two end portions with the end portions having diameters greater than that of the shaft portion. The shaft and end portions are preferably, but not necessarily cylindrical. It is to be understood that when a positioning pin is placed into a positioning channel of the lower diaphragm piece, as the upper diaphragm piece is lowered onto the lower piece, the positioning channel in the upper piece snugly and securely surrounds the top of the positioning pin.

The combined dimensions of the positioning pins and positioning channels are precisely machined to reestablish closely the original circularity of the uncut diaphragm using the cut diaphragm pieces. This highly repeatable precision achieved using precisely dimensioned pins and positioning channels obviates the need for adding any other material to the diaphragm pieces to reestablish circularity. The use of precisely machined pins and complementary positioning channels obviates the supplemental machining of the reassembled diaphragm which was required in the past for split diaphragm halves, which had weld material "buttered up" to fill in the material lost during the diaphragm cutting and separation phase.

The positioning pins may be made out of any suitable material depending upon the conditions to be encountered by the turbine itself. The pins may be made from any temperature tolerant material, such as metals, ceramics, or plastics, etc. The pins may be manufactured to extremely rigid size tolerances, such that the dimensions of the pins closely match the dimensions of the positioning grooves. Preferably the tolerances of the pin dimensions to the groove dimensions will vary only from about 1 to about $^{10}/_{1000}$ inch, more preferably from about 2 to about $^{5}/_{1000}$ inch. Nevertheless, the pins may be preferably made inexpensively in high volume batches due to the high degree of standardization.

The actual dimensions of the positioning pin are not critical so long as the dimensions of the positioning channels closely match those of the pins. The end portions of the pins may be identical or different depending upon the preferred design of the diaphragm. In the embodiment shown in the figures, the front end portion of the pin 14*a* has a smaller width than does the back end portion 14*c*. This is done to facilitate the placement of the covering seal 18 used to cover the front of the pins, and the gap left by the cut made in the diaphragm. The end portions of the pin could be similarly dimensioned if the countersunk portion at the front of the positioning channel is made larger to accommodate the seal. It is understood that the term "front" refers to the side of the diaphragm which faces the flow of fluid or gas passing through the turbine.

Grooves 17 are machined into one or both of the lower and upper diaphragm pieces 5, 5*a* either during, before, or after the cutting of the diaphragm into the two pieces 5, 5*a*. Seals 18 are inserted into the grooves 17. The positioning pins 13, 14 are placed into the positioning channels 15, 16, respectively. It is understood that the seals 18 would not be placed across or into features of the diaphragm through which air or liquid flow or movement are expected. Therefore, the seals 18 do not interfere with the shaft opening 10 or the annular blade row 8.

The seals may be made from any suitable material able to withstand the operating temperatures of the turbine in use. The seals are preferably made from metals, metal alloys, ceramics or plastics, with stainless steel seals being particularly preferred.

The dimensions of the positioning channels are the combined result of the way the axially drilled openings are drilled and the way the diaphragm is cut apart, with the cut intersecting the axially drilled holes. It is to be understood that any drilling or machining and cutting which results in a "dumbbell" shaped cavity or positioning groove is contemplated by the present invention. It is thought that precision and simplicity are enhanced if the diaphragm is first drilled at precisely predetermined locations on the surface of the front of the diaphragm, followed by axially or radially cutting the diaphragm such that the drilled openings are intersected and preferably bisected by the cut. However, it is contemplated that the diaphragm could first be cut followed by precision drilling. The grooves can be cut by means of a complex cutting tool which cut the groove and make the diaphragm cut simultaneously, or the groove may be cut in a separate step, either before or after the separation of the diaphragm into two pieces.

The positioning pins of the present invention in combination with the complementary positioning channels produce a highly repeatable, predictable, efficient and cost-effective means of reestablishing and maintaining the circularity of the diaphragm, while also stabilizing, in multiple directions, the upper and lower diaphragm parts. Superior interchangeability, especially with respect to replacement parts is also effected through the use of the present invention.

Since the turbine diaphragms must be fitted about the turbine shaft which passes therethrough, it has been conventional for the diaphragms to be bisected, or cut diametrically across the diaphragm, cutting the diaphragm into two relatively equal pieces or halves. The present invention also contemplates cutting the diaphragm across a predetermined line, non-diametrically, such that the two cut diaphragm pieces are not equal in dimension. To facilitate diaphragm assembly and removal away from a turbine shaft, it is understood that the cut made to the original one piece diaphragm must pass through at least a portion of the turbine shaft opening, which is preferably a circular opening, although not necessarily bisecting the shaft opening.

It is further understood that the axially disposed opening in the diaphragm may be made by a means other than drilling. For example, the axially disposed openings may be made by applying laser radiation, mechanically punching, melting, etc.

Many other modifications and variations of the present invention are possible to the skilled practitioner in the field in light of the teachings herein. It is therefore understood that, within the scope of the claims, the present invention can be practiced other than as herein specifically described.

What is claimed:

1. A method for machining a diaphragm for a turbomachine comprising:

providing the diaphragm having axially-spaced first and second sides with an opening extending along a first axis and through said first and second sides;

drilling at least one hole of a first diameter through the diaphragm from an entry point at the first side to an exit point at the second side of the diaphragm along a second axis substantially parallel to the first axis;

cutting the diaphragm into first and second pieces along a line intersecting the at least one hole to form matching edges in the first and second diaphragm pieces with matching axially extending positioning channels at the edges of the first and second pieces;

placing a positioning pin into each axially extending positioning channel of the first diaphragm piece, said positioning pin being configured to conform to the positioning channel dimensions; and joining the second diaphragm piece together with the first diaphragm piece with each positioning channel of the second diaphragm piece aligned with the positioning pin in each positioning channel of the first piece.

2. The method according to claim 1 further comprising cutting a groove along the edges of at least one of the first and second diaphragm pieces and through the hole after said cutting of the diaphragm; and inserting a seal into the groove of at least one of the first or second diaphragm pieces before said joining.

3. The method according to claim 1 wherein said cutting is carried out diametrically across the diaphragm.

4. The method according to claim 1 wherein said cutting is carried out non-diametrically across the diaphragm.

5. The method according to claim 1 wherein said cutting is carried out with a blade.

6. The method according to claim 1 wherein said cutting is carried out with a laser.

7. The method according to claim 1 wherein the positioning pins comprise a shaft portion having a first diameter and first and second end portions, said end portion diameters being greater than the shaft portion diameter.

8. The method according to claim 1 wherein the entry point and the exit point of the at least one hole is widened such that the diameter of the entry point and exit point is larger than the diameter of the drilled hole.

9. A method for machining a diaphragm for a turbomachine comprising:

providing the diaphragm having axially-spaced first and second sides with an opening extending along a first axis and through said first and second sides;

cutting the diaphragm into first and second pieces;

rigidly stabilizing the first and second diaphragm pieces;

drilling at least one hole of a first diameter axially through the separated first and second pieces from an entry point at the first side to an exit point at the second side of the diaphragm along a second axis substantially parallel to the first axis to form a positioning channel;

placing a positioning pin into each axially extending positioning channel of the first diaphragm piece, said positioning pin being configured to conform to the positioning channel dimensions; and joining the second diaphragm piece together with the first diaphragm piece with each positioning channel of the second diaphragm piece aligned with the positioning pin in each positioning channel of the first diaphragm piece.

10. The method according to claim 9 further comprising cutting a groove along the edges of the first and second diaphragm pieces after said cutting of the diaphragm; and inserting a seal into the groove formed in the first and second diaphragm pieces.

11. The method according to claim 9 wherein said cutting is carried out diametrically across the diaphragm.

12. The method according to claim 9 wherein said cutting is carried out non-diametrically across the diaphragm.

13. A diaphragm for use in a turbomachine comprising:

an outer annular supporting structure and an inner annular supporting structure with an annular blade row positioned therebetween, said inner annular supporting structure having an axial shaft opening with a diameter sufficient to receive a turbine shaft which extends along a first axis, wherein said diaphragm is cut into first and second pieces having adjoining edges extending through the outer and inner annular supporting structures, the annular blade row, and the opening;

axially extending positioning channels formed at the adjoining edges of the first and second pieces, through the diaphragm, and extending along a second axis substantially parallel to the first axis; and at least one positioning pin positioned in and conforming to the positioning channels of the first and second pieces.

14. The diaphragm according to claim 13 wherein each of the first and second pieces have about the same dimensions.

15. The diaphragm according to claim 13, wherein the first and second diaphragm pieces have differing dimensions.

16. The diaphragm according to claim 13 wherein the first and second pieces have a groove cut to a predetermined depth and width into and along the length of the cut surface of the first and second diaphragm pieces.

17. The diaphragm according to claim 16 wherein at least one seal is positioned into the groove.

18. The diaphragm according to claim 13 wherein said shaft opening is circular.

19. The diaphragm according to claim 13 wherein said positioning pin has a pair of opposing end portions, said end portions of said positioning pin have the same diameters and differing thicknesses.

20. The diaphragm according to claim 13 wherein said positioning pin has a pair of opposing end portions, said end portions of said positioning pin have the same diameters and the same thicknesses.

21. A turbine comprising:

a diaphragm comprising an outer annular supporting structure, and an inner annular supporting structure with an annular blade row positioned therebetween, said inner annular supporting structure having an axial shaft opening with a diameter sufficient to receive a turbine shaft which extends along a first axis, wherein said diaphragm is cut into first and second pieces having adjoining edges extending through the outer and inner annular supporting structures, the annular blade row, and the opening;

axially extending positioning channels formed at the adjoining edges of the first and second pieces, through the diaphragm, and extending along a second axis substantially parallel to the first axis; and at least one positioning pin positioned in and conforming to the positioning channels of the first and second pieces.

22. The turbine according to claim 21 wherein each of the first and second pieces of the diaphragm have about the same dimensions.

23. The turbine according to claim 21, wherein the first and second diaphragm pieces have differing dimensions.

24. The turbine according to claim 21 wherein the first and second diaphragm pieces have a groove cut to a predetermined depth and width into and along the length of the cut surface of the first and second diaphragm pieces.

25. The turbine according to claim 24 wherein at least one seal is positioned into the groove.

26. The turbine according to claim 21 wherein said shaft opening is circular.

27. The turbine according to claim 21 wherein said positioning pin has a pair of opposing end portions, said end portions of said positioning pin have the same diameters and differing thicknesses.

28. The diaphragm according to claim 21 wherein said positioning pin has a pair of opposing end portions, said end portions of said positioning pin have the same diameters and the same thicknesses.

* * * * *